US008917224B2

(12) United States Patent
Wu et al.

(10) Patent No.: US 8,917,224 B2
(45) Date of Patent: Dec. 23, 2014

(54) PIXEL UNIT CIRCUIT AND OLED DISPLAY APPARATUS

(75) Inventors: Zhongyuan Wu, Beijing (CN); Liye Duan, Beijing (CN); Gang Wang, Beijing (CN); Tian Xiao, Beijing (CN)

(73) Assignee: Boe Technology Group Co., Ltd., Beijing (CN)

( * ) Notice: Subject to any disclaimer, the term of this patent is extended or adjusted under 35 U.S.C. 154(b) by 212 days.

(21) Appl. No.: 13/474,310

(22) Filed: May 17, 2012

(65) Prior Publication Data

US 2012/0293482 A1 Nov. 22, 2012

(30) Foreign Application Priority Data

May 18, 2011 (CN) ..... 2011 1 0129681

(51) Int. Cl.
*G09G 3/30* (2006.01)
*G09G 3/32* (2006.01)

(52) U.S. Cl.
CPC ..... *G09G 3/3233* (2013.01); *G09G 2320/043* (2013.01); *G09G 2300/0852* (2013.01); *G09G 2320/045* (2013.01); *G09G 2300/0861* (2013.01); *G09G 2300/0819* (2013.01)
USPC ..... 345/76; 345/77; 345/89; 315/169.1

(58) Field of Classification Search
CPC ..... G09G 3/30; G09G 3/32; G09G 3/3208; G09G 3/3225; G09G 3/3233; G09G 3/3241; G09G 3/325; G09G 3/3258
USPC ..... 345/76–83; 315/169.1–169.3
See application file for complete search history.

(56) References Cited

U.S. PATENT DOCUMENTS

| | | | | |
|---|---|---|---|---|
| 8,358,297 | B2 * | 1/2013 | Tanikame et al. | 345/211 |
| 2006/0022305 | A1 | 2/2006 | Yamashita | |
| 2007/0063932 | A1 | 3/2007 | Nathan et al. | |
| 2009/0108763 | A1 * | 4/2009 | Han et al. | 315/169.3 |
| 2010/0277401 | A1 * | 11/2010 | Takahara et al. | 345/76 |
| 2011/0141160 | A1 | 6/2011 | Nathan et al. | |

FOREIGN PATENT DOCUMENTS

| | | | |
|---|---|---|---|
| CN | 101305409 | A | 11/2008 |
| KR | 20090042006 | A | 4/2009 |
| KR | 100901778 | B1 | 6/2009 |

OTHER PUBLICATIONS

Extended European Search Report; dated Nov. 2, 2013; Appln. No. 12168486.4-1930/2525348.
KIPO OA dated Aug. 21, 2013; Appln. No. KR10-2012-0053041.
First Chinese Office Action dated Jan. 3, 2014; Appln. No. 201110129681.8.

(Continued)

*Primary Examiner* — Jennifer Nguyen
(74) *Attorney, Agent, or Firm* — Ladas & Parry LLP

(57) ABSTRACT

The present disclosure discloses a pixel unit circuit and an OLED display apparatus. The pixel unit circuit comprises a first sub-circuit module, a second sub-circuit module, a first capacitor and OLED. An input of the first sub-circuit module is connected to a data line; another input of the first sub-circuit module is connected to an output of the second sub-circuit module and a first terminal of the OLED; an output of the first sub-circuit module is connected to an input/output of the second sub-circuit module via the first capacitor; a voltage difference between positive power supply and negative power supply of a backboard is applied between an input of the second sub-circuit module and a second terminal of the OLED. The pixel unit circuit can compensate the aging of OLED devices, the non-uniformity of threshold voltage of TFT driving transistors, and IR Drop of the power supply of the backboard.

8 Claims, 9 Drawing Sheets

(56) References Cited

OTHER PUBLICATIONS

European Patent Office Communication dated Jan. 6, 2014; Appln. No. 12 168 486.4—1903.

Korean Patent Office Notice of Allowance Dated Feb. 27, 2014; Appln. No. 10-2012-0053042.

Second Chinese Office Action dated Sep. 2, 2014; Appln. No. 201110129681.8.

* cited by examiner

PIXEL UNIT CIRCUIT AND OLED DISPLAY APPARATUS

CROSS REFERENCE TO RELATED APPLICATIONS

This application claims the benefit of Chinese Patent Application No. 201110129681.8 filed May 18, 2011, the entire disclosure of which is incorporated herein by reference.

TECHNICAL FIELD OF THE DISCLOSURE

The present disclosure relates to a pixel unit circuit, and an OLED (Organic Light-Emitting Diode) display apparatus.

BACKGROUND

As a current type light emitting device, OLED is increasingly applied to a high performance display. Conventional Passive Matrix OLED (PMOLED) requires shorter single pixel driving time for display, and thus needs increasing a transient current, rendering the increase of the power consumption; meanwhile, the employment of large current causes voltage drop of the Indium Tin Oxide (ITO) line to decrease too much, rendering the operation voltage of OLED too high and in turn the efficiency of OLED lower. An Active Matrix OLED (AMOLED) inputs OLED current via switching transistors by progressive scanning for display, which can solve the above problems very well.

Firstly, as an example, in the design for the backboard of AMOLED, a low temperature poly-Si Thin Film Transistor (LTPS TFT) is mostly adopted in AMOLED to constitute a pixel circuit for providing the corresponding current for the AMOLED device. As compared to the conventional amorphous-si TFT, LTPS TFT has a higher mobility and a more stable characteristics, and thus is more suitable to be used in an AMOLED display. However, due to the limitation of the crystallization process, LTPS TFTs, which are manufactured on a large glass substrate, have non-uniformity in electrical parameters such as threshold voltage, mobility, etc, and such non-uniformity may result in variances of current and luminance of OLED which can be perceived by human eyes, i.e., Mura phenomenon.

Secondly, in a large size display application, there is a certain resistance in the power cord of the backboard, and all of pixels are provide with driving current by the positive power supply (ARVDD) of the backboard, so the supply voltage in the area near the location of the power supply ARVDD is higher than that in the area located far from the location of the power supply ARVDD, and such phenomenon is called IR Drop. As the current of OLED depends on the voltage of ARVDD, IR Drop also results in variances of current in different areas, and Mura phenomenon in turn occurs in display.

Thirdly, there is also the non-uniformity in electrical parameters due to the non-evenness of the film thickness generated when OLED device is evaporated. FIG. 1 illustrates a schematic relationship between the luminance and the operation time of OLED and relationship between the threshold voltage and the operation time of OLED, wherein —▲— denotes luminance of OLED and —◆— denotes threshold voltage of OLED. As shown in FIG. 1, after OLED operates for a long time, the deterioration of the internal electrical performance of OLED results in the rise of the threshold voltage $V_{OLED_0}$, and thus luminance efficiency decreases and luminance lowers.

It becomes an important issue that how to compensate the aging of the OLED device, since the aging of OLED causes Image Sticking to present in the area which displays a fixed picture for long time, affecting the display effect.

FIG. 2 illustrates a schematic relationship between luminance loss and threshold voltage of OLED, and FIG. 3 illustrates a schematic relationship between luminance and current density of OLED. As shown in FIG. 3, "—●—" denotes the relationship between the luminance of red light OLED and the current density, "—◆—" denotes the relationship between the luminance of green light OLED and the current density, and "—◀—" denotes the relationship between the luminance of blue light OLED and the current density. As illustrated in FIG. 2 and FIG. 3, a substantially linear relationship is represented between the rise of threshold voltage and the luminance loss of OLED, and a linear relationship is also represented between the current density and the luminance of OLED. Therefore, when compensating the aging of OLED, the luminance loss can be compensated by increasing the driving current of OLED linearly as the threshold voltage of OLED increases.

AMOLED can be classed into three types in driving mode, i.e., digital driving mode, current driving mode, and voltage driving mode. The digital driving mode achieves a grey level by controlling driving time via TFT as a switch without compensating non-uniformity. Nevertheless, the operation frequency will be multiplied as the size of a display increases, which results in a high power consumption and to some extent reaches the physical limit of design. Therefore, the digital driving mode is not suitable for a large size display. The current driving mode achieves a grey level by providing different current to the driving transistors directly, which can compensate the non-uniformity of TFT and IR Drop. However, when a signal of a low grey level is written, the time for writing is prolonged too much since it is a small current to charge the large parasitic capacitance on a data line. Such a problem is more serious in a large size display and is difficult to be overcome. The voltage driving mode is similar to the conventional AMLCD driving mode, wherein a voltage signal representing a grey level is provided by a driving IC, and the voltage signal is converted to a current signal of a driving transistor inside a pixel circuit, and then the current signal is used to drive OLED to achieve luminance grey level. The voltage driving mode has such advantages as high driving speed and simplicity of implementation, and thus is suitable for driving a large size panel and is widely used in the art. However, extra devices such as TFTs and capacitors to compensate non-uniformity of TFT and IR Drop will be required.

FIG. 4 is a schematic diagram showing structure of a conventional pixel unit circuit of voltage driving type which comprises 2 TFT transistors, 1 capacitor and an OLED. A switching transistor T2 transmits a data voltage from a data line to a gate of a driving transistor T1, the driving transistor T1 converts the data voltage to a corresponding current and supplies the same to the OLED. In normal operation, the driving transistor T1 should operate in a saturation area, and should provide a constant current during a scanning time for one line. The current can be expressed as follows:

$$I_{OLED} = \frac{1}{2}\mu_P \cdot C_{ox} \cdot \frac{W}{L} \cdot (V_{Data} - ARVDD - V_{th})^2$$

wherein $\mu_P$ is the carrier mobility, $C_{OX}$ is the capacitance of the oxide layer of the gate, W/L is the width/length ratio of the transistor, $V_{Data}$ is the data voltage, ARVDD is the power supply voltage of AMOLED backboard which is shared by all pixel units, and $V_{th}$ is the threshold voltage of the driving transistor. It can be known that if the threshold voltages $V_{th}$ are different from one pixel unit to another, then there are variances between the currents. Moreover, even if a constant current is provided to an OLED device, the emitting luminance of OLED decreases as the aging of the OLED device.

At present, there are a variety of structures of pixel unit for compensating the non-uniformity of $V_{th}$ and IR drop. However, some structures of pixel unit can compensate the non-uniformity of $V_{th}$ of the driving transistor, but can not compensate IR Drop and the luminance loss due to the aging of OLED; some structures of pixel unit can compensate the non-uniformity of $V_{th}$ of the driving transistor and IR Drop, but can not compensate the luminance loss due to the aging of OLED; some structures of pixel unit can compensate the non-uniformity of $V_{th}$ of the driving transistor, IR Drop and the affect of the aging of OLED, but are not applicable to a large size panel since their structures belong to the current driving type; and some structures of pixel unit can compensate the affect of the aging of OLED, but can not compensate the non-uniformity of $V_{th}$ and IR Drop. Therefore, it is impossible for the pixel circuit presented in the prior art to effectively compensate the non-uniformity of the threshold voltage $V_{th}$ of TFT driving transistor, IR Drop of power supply voltage of backboard and the affect of the aging of OLED while applicable to a large size panel.

SUMMARY

In view of the above, the present disclosure provides a pixel unit circuit and an OLED display apparatus, which can effectively compensate the non-uniformity of threshold voltage of TFT driving transistor, IR Drop of the power supply voltage of backboard and the affect of the aging of OLED device, and can be applicable to a large size panel.

In an embodiment of the present disclosure, there is provided a pixel unit circuit, the pixel unit circuit includes a first sub-circuit module, a second sub-circuit module, a first capacitor and an Organic Light-Emitting Diode (OLED), wherein one input of the first sub-circuit module is connected to a data line; the other input of the first sub-circuit module is connected to an output of the second sub-circuit module and a first terminal of the OLED; an output of the first sub-circuit module is connected to an input/output of the second sub-circuit module via the first capacitor; and a voltage difference of positive power supply and negative power supply of a backboard is supplied between an input of the second sub-circuit module and a second terminal of the OLED.

In one example, the first sub-circuit module is used for selecting an input voltage to be output to the first capacitor and the second sub-circuit module is used for converting the input voltage into a current to be provided to the OLED.

In one example, the first terminal of the OLED is an anode of the OLED (4), and the second terminal of the OLED is a cathode of the OLED (4), the other input of the first sub-circuit module 1 is connected to the anode of the OLED 4, and the output of the first sub-circuit module 1 is ND node and is connected to one terminal of the first capacitor 3; the input of the second sub-circuit module 2 is connected to the positive power supply ARVDD of the backboard, the input/output of the second sub-circuit module 2 is NG node and is connected to the other terminal of the first capacitor 3, the output of the second sub-circuit module 2 is connected to the anode of OLED 4; and the cathode of the OLED 4 is connected to the negative power supply ARVSS of the backboard.

Preferably, the first sub-circuit module 1 includes a first transistor 11 and a second transistor 12, wherein the first and second transistors 11 and 12 are P type TFT transistors; wherein, a gate of the first transistor 11 receives a control signal SCAN, a source thereof is connected to the data line, and a drain thereof is connected to the ND node; a gate of the second transistor 12 receives a control signal EMB, a drain thereof is connected to the ND node, and a source thereof is connected to the anode of the OLED 4.

Preferably, the second sub-circuit module 2 includes a third transistor 21, a fourth transistor 22, a fifth transistor 23 and a second capacitor 24, wherein the third, fourth and fifth transistors 21, 22 and 23 are P type transistors; wherein a gate of the third transistor 21 is connected to the NG node, and a drain thereof receives ARVDD; a gate of the fourth transistor 22 receives a control signal EMB, a drain thereof is connected to the NG node, and a source thereof is connected to the source of the third transistor 21; a gate of the fifth transistor 23 receives a control signal EM, a drain thereof is connected to the source of the third transistor 21, and the source thereof is connected to the anode of the OLED 4; and one terminal of the second capacitor 24 is connected to the NG node, and the other terminal thereof is connected to ARVDD.

In one example, the pixel unit circuit operates in the following sequence: a first phase, wherein SCAN is at high level, EM and EMB are at low level, and thus the second transistor 12, the third transistor 21, the fourth transistor 22 and the fifth transistor 23 switch on, the first transistor 11 switches off, and the first capacitor 3 is discharged; a second phase, wherein SCAN is at high level, EMB is at low level, and EM is at high level, and thus at the moment that the EM toggles high, the second transistor 12, the third transistor 21 and the fourth transistor 22 switch on, the first and fifth transistors 11 and 23 switch off, the third transistor 21 functions as a diode, then the voltage at the NG node is charged by ARVDD and rises gradually to switch the third transistor 21 off, and at the same time, the ND node is discharged by the OLED 4; a third phase, wherein SCAN is at low level, and EM and EMB are at high level, and thus the first and the third transistors 11 and 21 switch on, the second, fourth and fifth transistors 12, 22 and 23 switch off; and a fourth phase, wherein SCAN is at high level, EM is at low level, and EMB is at high level, and thus the third and fifth transistors 21 and 23 switch on, the first, second and fourth transistors 11,12 and 22 switch off, and the OLED 4 emits light.

In another example, the first terminal of the OLED is a cathode of the OLED (4'), and the second terminal of the OLED is an anode of the OLED (4'), the other input of the first sub-circuit module 1' is connected to the cathode of the OLED 4', and the output of the first sub-circuit module 1' is ND' node and is connected to one terminal of the first capacitor 3'; the input of the second sub-circuit module 2' is connected to ARVSS, the input/output of the second sub-circuit module 2' is NG' node and is connected to the other terminal of the first capacitor 3', the output of the second sub-circuit module 2' is connected to the cathode of the OLED 4'; and the anode of the OLED 4' is connected to ARVDD.

Preferably, the first sub-circuit module 1' includes a first transistor 11' and a second transistor 12', wherein the first and second transistors 11' and 12' are N type TFT transistors; wherein, a gate of the first transistor 11' receives a control signal SCAN', a source thereof is connected to the data line, and a drain thereof is connected to the ND' node; a gate of the second transistor 12' receives a control signal EMB', a drain thereof is connected to the ND' node, and a source thereof is connected to the cathode of the OLED 4'.

Preferably, the second sub-circuit module 2' includes a third transistor 21', a fourth transistor 22', a fifth transistor 23' and a second capacitor 24', wherein the third, fourth and fifth transistors 21', 22' and 23' are N type TFT transistors; wherein a gate of the third transistor 21' is connected to the NG' node, and a drain thereof receives ARVSS; a gate of the fourth transistor 22' receives a control signal EMB', a drain thereof is connected to the NG' node, and a source thereof is connected to the source of the third transistor 21'; a gate of the fifth transistor 23' receives a control signal EM', a drain thereof is connected to the source of the third transistor 21', and the source thereof is connected to the cathode of the OLED 4'; and one terminal of the second capacitor 24' is connected to the NG' node, and the other terminal is connected to ARVSS.

In one example, the pixel unit circuit operates in the following sequence: a first phase, wherein SCAN' is at low level, EM' and EMB' are at high level, and thus the second transistor 12', the third transistor 21', the fourth transistor 22' and the fifth transistor 23' switch on, the first transistor 11' switches off, and the first capacitor 3' is discharged; a second phase, wherein SCAN' is at low level, EMB' is at high level, and EM' is at low level, and thus the second transistor 12', the third transistor 21' and the fourth transistor 22' switch on, the first and fifth transistors 11' and 23' switch off, the third transistor 21' functions as a diode, then the voltage at the NG' node is discharged to ARVSS by the third transistor 21' and decreases gradually to switch the third transistor 21' off, and at the same time, the ND' node is charged by ARVDD; a third phase, wherein SCAN' is at high level, and EM' and EMB' are at low level, and thus the first and third transistors 11' and 21' switch on, the second, fourth and fifth transistors 12', 22' and 23' switch off; and a fourth phase, wherein SCAN' is at low level, EM' is at high level, and EMB is at low level, and thus the third and fifth transistors 21' and 23' switch on, the first, second and fourth transistors 11',12' and 22' switch off, and the OLED 4' emits light.

In another embodiment of the present disclosure, there is provided an OLED display apparatus including a plurality of the pixel unit circuits connected in series, each of the pixel unit circuits includes: a first sub-circuit module, a second sub-circuit module, a first capacitor and an Organic Light-Emitting Diode (OLED), wherein one input of the first sub-circuit module is connected to a data line; the other input of the first sub-circuit module is connected to an output of the second sub-circuit module and a first terminal of the OLED; an output of the first sub-circuit module is connected to an input/output of the second sub-circuit module via the first capacitor; and a voltage difference between positive power supply and negative power supply of a backboard is applied between an input of the second sub-circuit module and a second terminal of the OLED.

Compared to the conventional pixel unit circuit, the pixel unit circuit of the disclosure can effectively compensate the aging of OLED devices, the non-uniformity of threshold voltage of TFT driving transistors, and IR Drop of the power supply of the backboard, and enhance the display effect. Since the pixel unit circuit proposed in the present disclosure is designed based on a voltage feedback technique, and thus can be applicable to a large size panel.

BRIEF DESCRIPTION OF THE DRAWINGS

The present disclosure will become more fully understood from the detailed description given hereinafter and the accompanying drawings which are given by way of illustration only, and thus are not limitative of the present disclosure and wherein.

DETAILED DESCRIPTION

In summary, a pixel unit circuit proposed in the present disclosure includes a first sub-circuit module, a second sub-circuit module, a capacitor and an Organic Light-Emitting Diode (OLED), wherein one input of the first sub-circuit module is connected to a data line; the other input of the first sub-circuit module is connected to an output of the second sub-circuit module and one terminal of the OLED; an output of the first sub-circuit module is connected to an input/output of the second sub-circuit module via a capacitor; and a voltage difference between positive power supply and negative power supply of a backboard is applied between an input of the second sub-circuit module and the other terminal of the OLED.

For example, the first sub-circuit module is used for selecting an input voltage to be output to the capacitor and the second sub-circuit module is used for converting the input voltage into a current to be provided to OLED.

Figure 1:
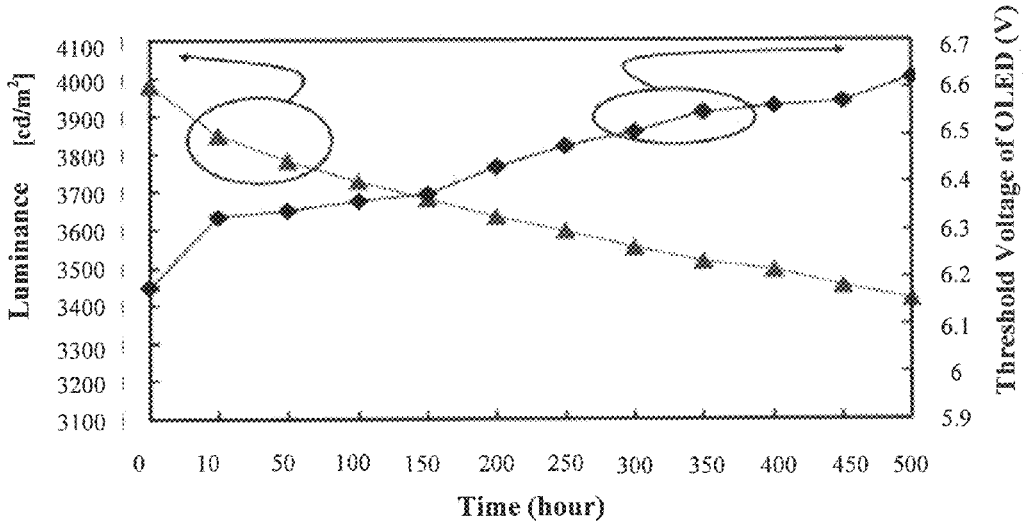
Prior Art Fig. 1
FIG. 1 is a schematic diagram showing relationship between the luminance and the operation time of OLED and relationship between the threshold voltage and the operation time of OLED.
Figure 2:
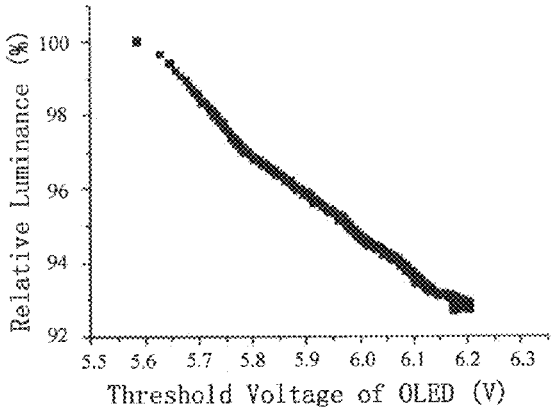
Prior Art Fig. 2
FIG. 2 is a schematic diagram showing relationship between the luminance loss and the threshold voltage of OLED.
Figure 3:
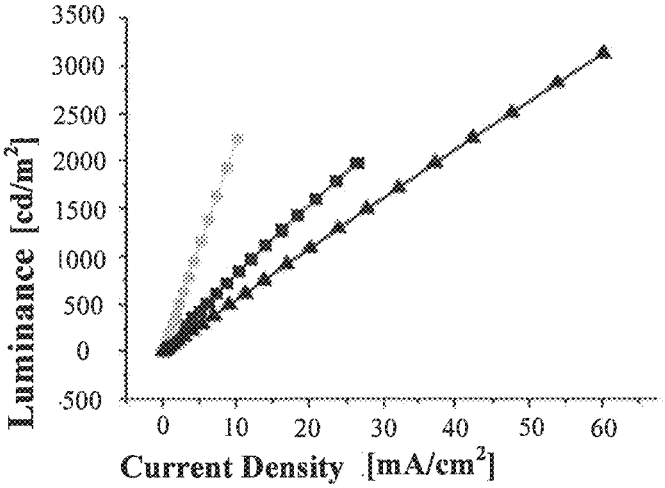
Prior Art Fig. 3
FIG. 3 is a schematic diagram showing relationship between the luminance and the current density of OLED.
Figure 4:
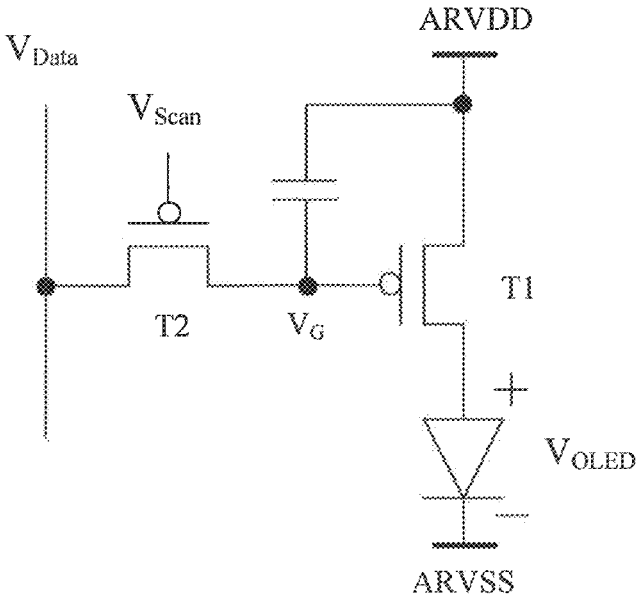
Prior Art Fig. 4
FIG. 4 is a schematic diagram showing the structure of a pixel unit circuit of voltage driving type in the prior art.
Figure 5:
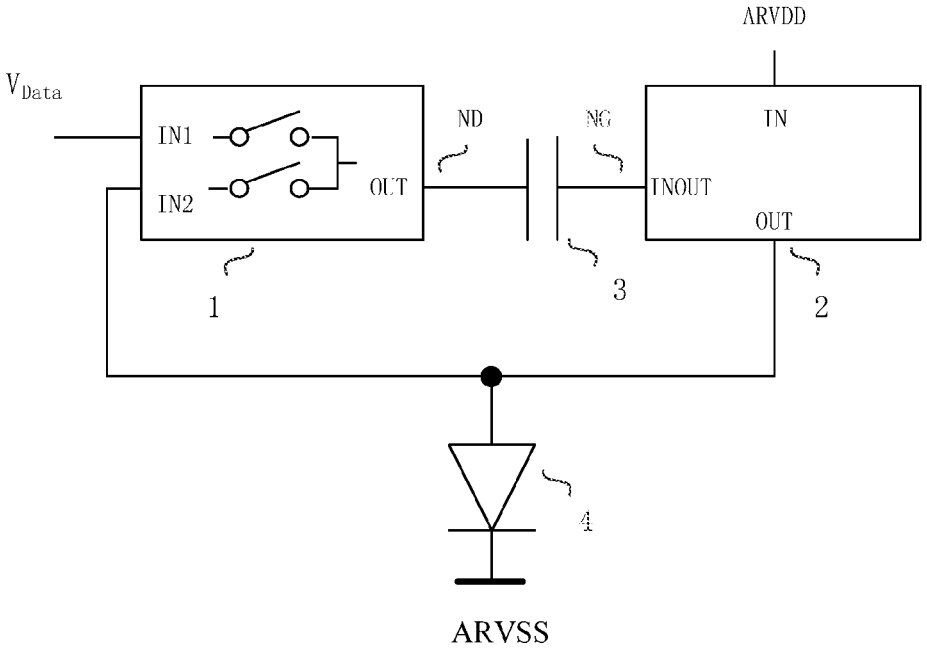
FIG. 5 is a schematic diagram showing the structure of a pixel unit circuit of an embodiment of the present disclosure.

FIG. 5 is a schematic diagram of the structure of a pixel unit circuit of one embodiment of the present disclosure. As illustrated in FIG. 5, the pixel unit circuit comprises a sub-circuit module 1, a sub-circuit module 2, a capacitor 3 and an OLED 4, wherein the sub-circuit module 1 has two inputs and one output, and the two inputs of the sub-circuit module 1 are connected to a data line and an anode of the OLED 4 respectively, the output of the sub-circuit module 1 is connected to one terminal of the capacitor 3; the sub-circuit module 2 has one input, one input/output and one output, wherein the input of the sub-circuit module 2 is connected to ARVDD, the input/output of the sub-circuit module 2 is connected to the other terminal of the capacitor 3, and the output of the sub-circuit module 2 is connected to the anode of the OLED 4. In this embodiment, the output of the sub-circuit module 1 is also referred to as ND node, the input/output of the sub-circuit module 2 is referred to as NG node. In other words, in the pixel unit circuit of the present embodiment, a data voltage $V_{Data}$ and the anode voltage of the OLED are input to the sub-circuit module 1, and the output of the sub-circuit module 1 is connected to the ND node; ARVDD is input to the sub-circuit module 2 as one input signal, one voltage input/output port of the sub-circuit module 2 is connected to the NG node, and one current output port of the sub-circuit module 2 is connected to the anode of the OLED 4; the capacitor 3 is connected between the NG node and the NG node; a cathode of the OLED 4 is connected to the negative power supply of the backboard (ARVSS).

In the pixel unit circuit shown in FIG. 5, the sub-circuit module 1 functions as selecting a voltage ($V_{Data}$ or $V_{OLED}$) to be input to ND, the sub-circuit module 2 functions as converting an input voltage into a current to be supplied to the OLED, and the function can be expressed as a formula as below:

$$f(V_{NG}, ARVDD, V_{th}) = I_{OLED}.$$

The operation of the pixel unit circuit can be divided into two phases, wherein the first phase is a compensation phase in which the voltage at the ND node is controlled to be $V_{OLED_0}$ ($V_{OLED_0}$ represents the threshold voltage of the OLED); at this time, the NG node of the sub-circuit module 2 functions as an output port, the voltage at the NG node is controlled to be ARVDD+$V_{th}$, wherein $V_{th}$ represents the threshold voltage of the driving transistor used in the pixel unit circuit; the second phase is an evaluation phase in which the voltage at the ND node output from the sub-circuit module 1 is controlled to be $V_{Data}$; at this time, the NG node of the sub-circuit module 2 functions as an input port; meanwhile, the voltage at the NG node can be expressed as $k\cdot(V_{Data}-V_{OLED_0})+ARVDD+V_{th}$ due to the bootstrap effect of the capacitor, and the sub-circuit module 2 converts the input voltage into a current, wherein the terms of ARVDD and $V_{th}$ from the above expression of the voltage at the NG node are removed, so that the output current is independent of ARVDD and $V_{th}$, which can be equivalent to compensating the non-uniform of the threshold voltage of the driving transistor and IR Drop. At the same time, the sub-circuit module 2 allows the output current to be proportional to $V_{OLED_0}$, that is, the higher $V_{OLED_0}$ is, the larger the output current is, and the relation between $V_{OLED_0}$ and the output current can be adjusted by a scale coefficient k so as to compensate decrease of current and lowering of luminous efficiency due to attenuation of OLED. Compared to the conventional pixel structure, the pixel unit circuit can effectively compensate the aging of OLED devices, the non-uniformity of threshold voltage of the TFT driving transistor, and the IR Drop of the power supply of backboard.

Figure 6:
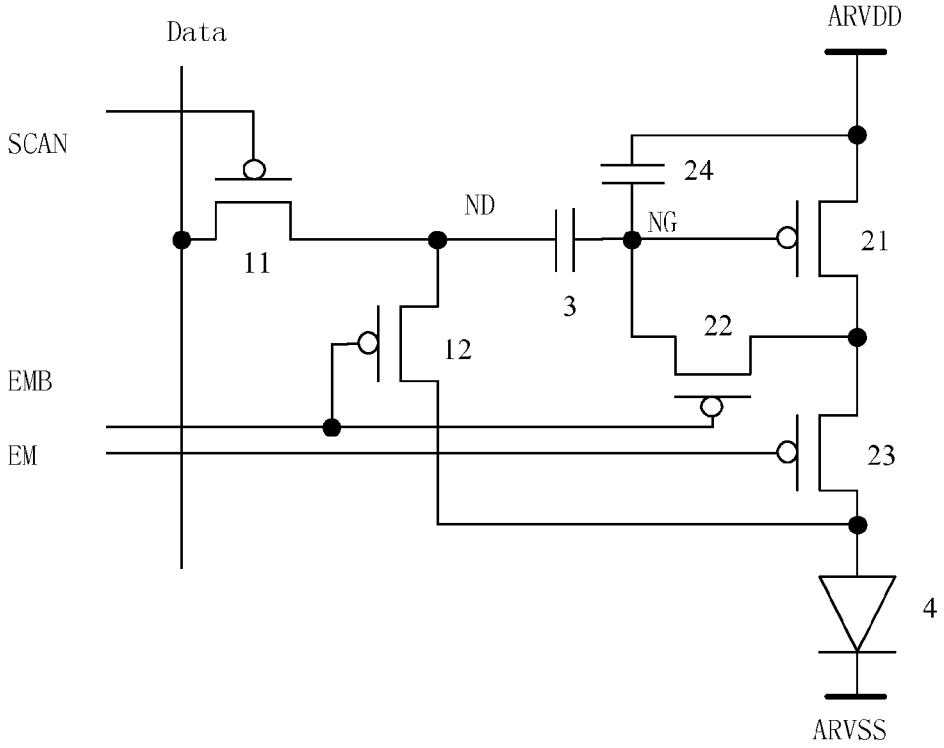
FIG. 6 is a schematic diagram showing the detailed structure of a pixel unit circuit of an embodiment of the present disclosure.
Figure 7:
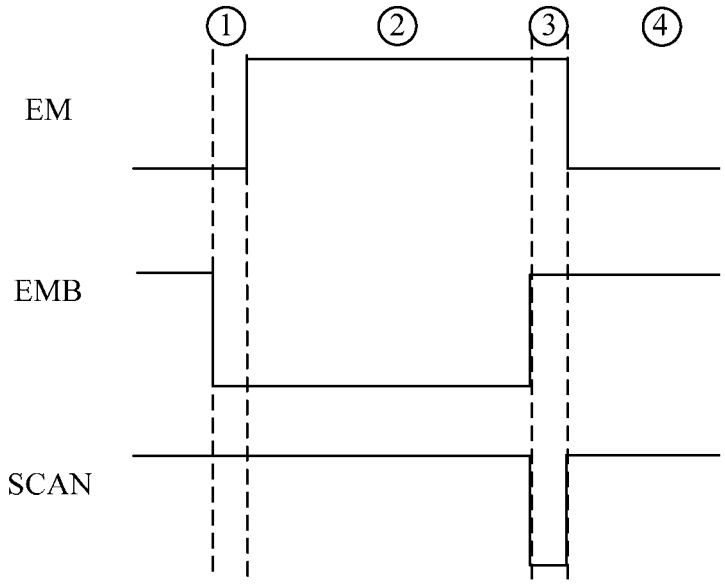
FIG. 7 is a schematic diagram showing the waveforms of control signals SCAN, EM, and EMB of an embodiment of the present disclosure.

FIG. 6 is a schematic diagram showing the detailed structure of a pixel unit circuit of an embodiment of the present disclosure. As illustrated in FIG. 6, the pixel unit circuit includes five P type TFT transistors, one OLED and two capacitors, wherein ARVDD is a high level power supply signal and ARVSS is a low level power supply signal. The whole circuit is controlled by three control signals SCAN, EM and EMB, and the waveforms of the three signals SCAN, EM and EMB are shown in FIG. 7.

Combining with FIG. 5 and FIG. 6, the sub-circuit module 1 includes transistors 11 and 12, the sub-circuit module 2 includes transistors 21, 22 and 24 as well as a capacitor 24.

A gate of the transistor 11 receives the control signal SCAN, a source thereof is connected to a data line, and a drain thereof is connected to ND node.

A gate of the transistor 12 receives the control signal EMB, a drain thereof is connected to the ND node (that is, the drain of the transistor 12 is coupled to the drain of the transistor 11), and a source thereof is connected to an anode of an OLED 4.

A gate of the transistor 21 is connected to the NG node, and a drain thereof receives ARVDD.

A gate of the transistor 22 receives the control signal EMB, a drain thereof is connected to the NG node, and a source thereof is connected to the source of the transistor 21.

A gate of the transistor 23 receives the control signal EM, a drain thereof is connected to the source of the transistor 21, and the source thereof is connected to the anode of the OLED 4.

One terminal of the capacitor 24 is connected to the NG node, and the other terminal is connected to ARVDD.

It can be seen that: the two inputs of the sub-circuit module 1 correspond to the sources of the transistors 11 and 12 respectively, the output of the sub-circuit module 1 corresponds to the drain of the transistor 11 or the drain of the transistor 12; the input of the sub-circuit module 2 corresponds to the drain of the transistor 21, the input/output of the sub-circuit module 2 corresponds to the gate of the transistor 21, and the output of the sub-circuit module 2 corresponds to the source of the transistor 23.

The operation of the pixel unit circuit as shown in FIG. 6, which is based on the waveforms of the control signals illustrated in FIG. 7, can be divided into four phases as below.

Figure 8:
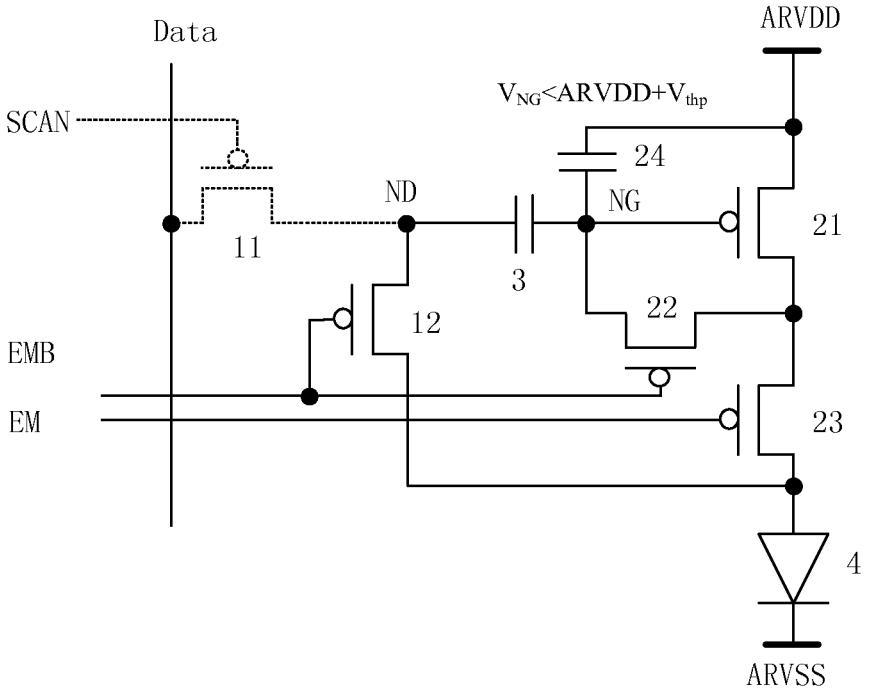
FIG. 8 is a schematic diagram showing an operation in a first phase of an embodiment of the present disclosure.

A first phase is a precharge period, as shown in FIG. 8. During this period, SCAN is at high level, and EM and EMB are at low level. At this time, the transistors 12, 21, 22 and 23 switch on, and the transistor 11 switches off; the capacitor 3 is discharged, and the potential of NG node is lower than ARVDD+$V_{th}$, wherein $V_{th}$ denotes the threshold voltage of the P type TFT transistor 21 ($V_{thp}<0$).

Figure 9:
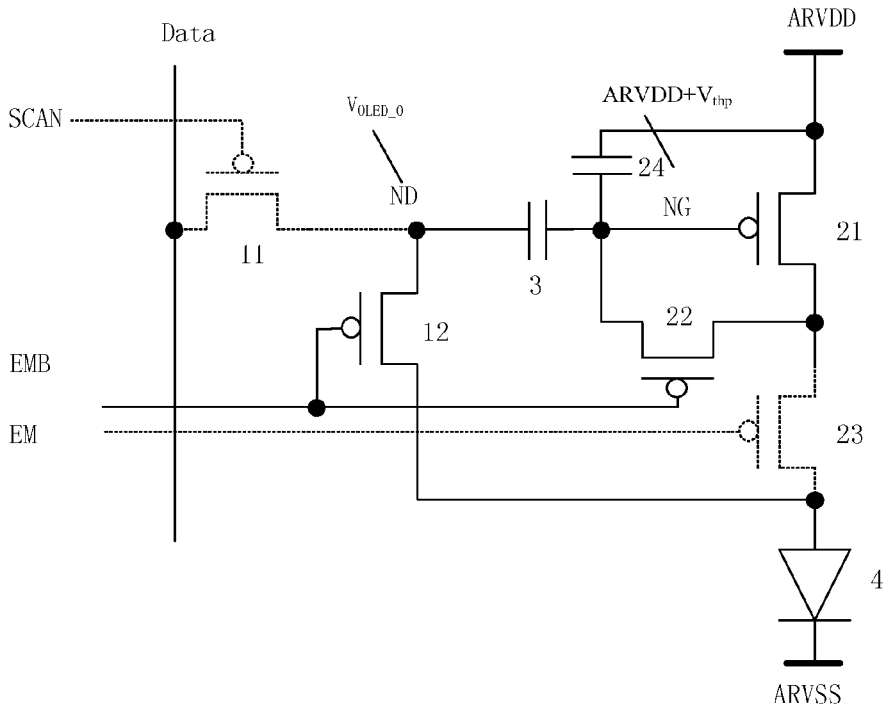
FIG. 9 is a schematic diagram showing an operation in a second phase of an embodiment of the present disclosure.

A second phase is a compensation period, as shown in FIG. 9. During this period, SCAN is at high level, EMB is at low level, and EM is at high level. At the moment that EM toggles high, the transistors 21, 22 and 12 switch on, and the transistor 11 and 23 switch off. The transistor 21 function as a diode, the NG node is charged by ARVDD and rises gradually up to ARVDD+$V_{thp}$ so as to switch off the transistor 21; and at the same time, the ND node is discharged by the OLED 4 until the OLED 4 turns off without current passing through, and at this moment, the voltage at the ND node is $V_{OLED_0}$, i.e., the threshold voltage of the OLED 4.

Figure 10:
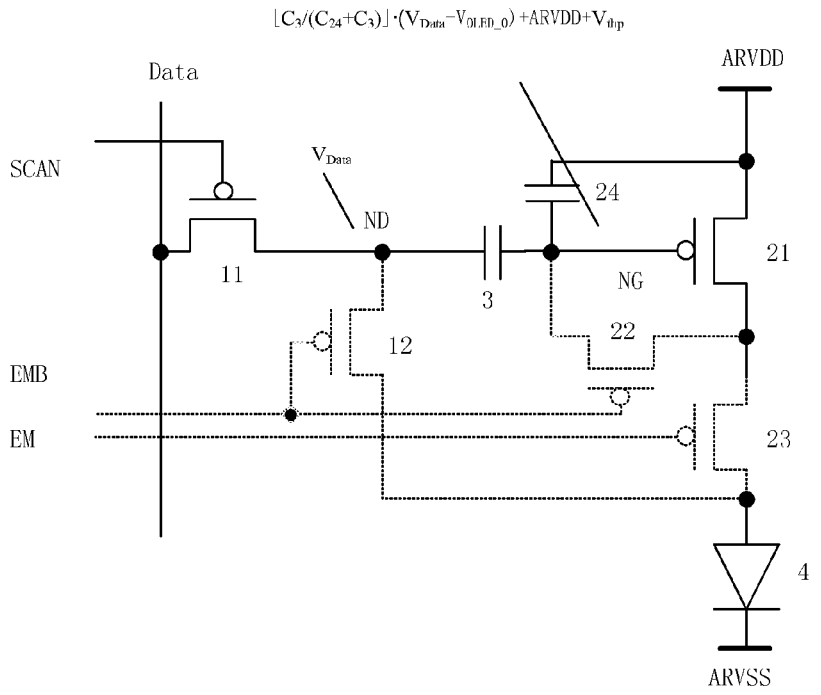
FIG. 10 is a schematic diagram showing an operation in a third phase of an embodiment of the present disclosure.

A third phase is an evaluation period, as shown in FIG. 10. During this period, SCAN is at low level, EM and EMB are at high level. The transistors 21 and 11 switch on, and the transistors 22, 12 and 23 switch off. At this time, the voltage on the data line is applied to the ND node of the capacitor 3; since there is no direct current path at NG node, the total quantity of electric charge at this node maintains unchanged compared to that in the second phase, as shown in the formula as follows:

$$(ARVDD+V_{thp}-V_{OLED_0})\cdot C_3+(ARVDD+V_{thp}-ARVDD)\cdot C_{24}=(V_{NG}-V_{Data})\cdot C_3(V_{NG}-ARVDD)\cdot C_{24}$$

it can be calculated as $$V_{NG}=[C_3/(C_3+C_{24})]\cdot(V_{Data}-V_{OLED_0})+ARVDD+V_{thp}.$$

Figure 11:
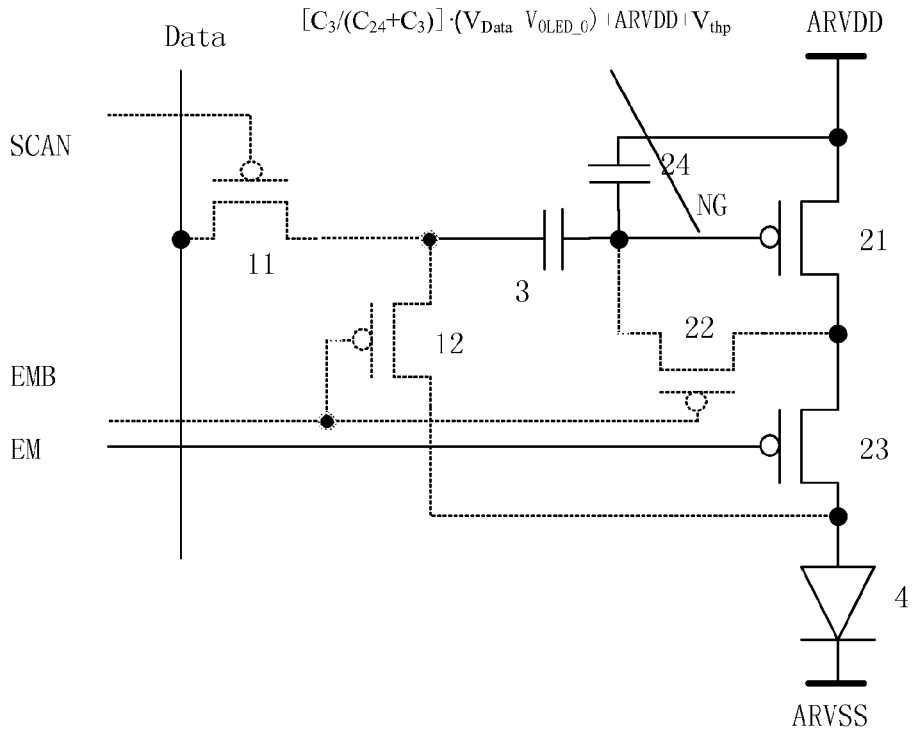
FIG. 11 is a schematic diagram showing an operation in a fourth phase of an embodiment of the present disclosure.

A fourth phase is a period for keeping light emitting, as shown in FIG. 11. During this period, SCAN is at high level, EM is at low level, and EMB is at high level. The transistor 21 and 23 switch on, and the transistors 22, 11 and 12 switch off. At this time, the voltage at NG node is kept by the capacitor 24; the OLED 4 is provided with a current for light emitting light after the transistor 23 switches on. The current flows through the transistor 21 is as follows:

$$\begin{aligned} I_{OLED} &= \frac{1}{2}\cdot\mu_p\cdot C_{ox}\cdot\frac{W}{L}\cdot([C_3/(C_{24}+C_3)]\cdot(V_{Data}-V_{OLED_0})+ARVDD+V_{thp}-ARVDD-V_{thp})^2 \\ &= \frac{1}{2}\cdot\mu_p\cdot C_{ox}\cdot\frac{W}{L}\cdot\left[\frac{C_3}{C_{24}+C_3}\cdot(V_{Data}-V_{OLED_0})\right]^2. \end{aligned}$$

It can be known from the above formula that the current flowing through the transistor 21 is independent of the threshold voltage and ARVDD, and thus the pixel unit circuit of the present embodiment substantively eliminates the affects of the non-uniformity of the threshold voltage of the transistor and IR Drop.

Figure 12:
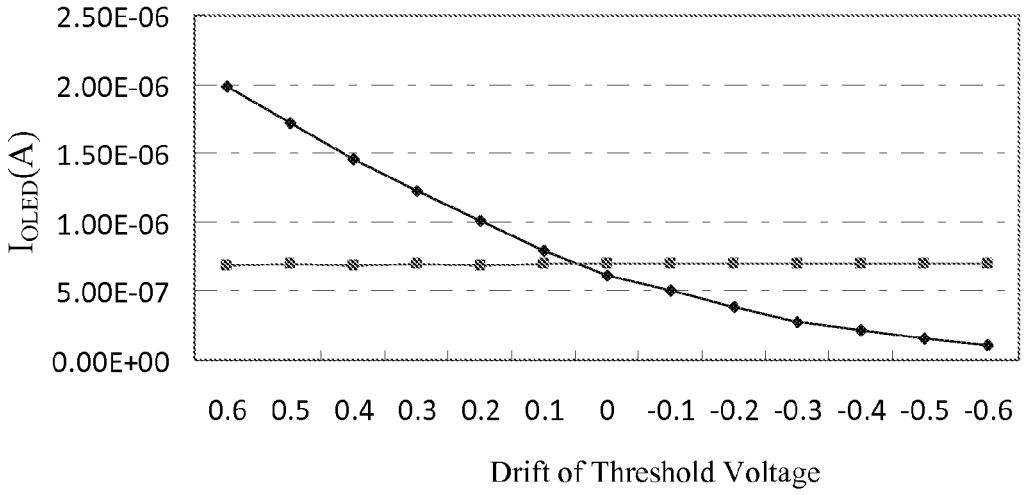
FIG. 12 is a schematic diagram of simulation result of a pixel unit circuit of an embodiment of the present disclosure for compensating non-uniformity of threshold voltage of transistor.

FIG. 12 is a schematic diagram of simulation result of a pixel unit circuit of an embodiment of the present disclosure for compensating non-uniformity of threshold voltage of the driving transistor, wherein —◆— represents the relation between the threshold voltage of the transistor and $I_{OLED}$ of the conventional structure of 2T1C, and —■— represents the relation between the threshold voltage of the transistor and $I_{OLED}$ of structure of 5T2C of the present embodiment. As shown in FIG. 12, when the threshold voltage drifts±0.6V, according to the conventional structure of 2T1C, the maximum current drift can reach 1.8 times of the normal current or more; while according to the structure of 5T2C of the present embodiment, the fluctuate of the current is less than 2.5%.

Figure 13:
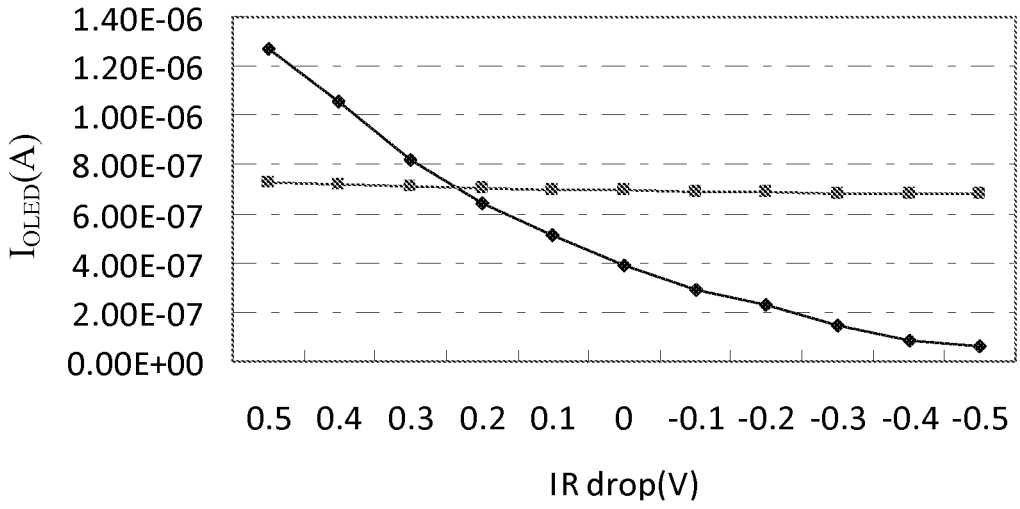
FIG. 13 is a schematic diagram of simulation result of a pixel unit circuit of an embodiment of the present disclosure for compensating IR Drop.

FIG. 13 is a schematic diagram of simulation result of a pixel unit circuit of an embodiment of the present disclosure for compensating IR Drop, wherein —◆— represents the relation between the voltage drop of ARVDD and $I_{OLED}$ of the conventional structure of 2T1C, and —■— represents the relation between the voltage drop of ARVDD and $I_{OLED}$ of structure of 5T2C of the present embodiment. As shown in FIG. 13, when the voltage drop of ARVDD drifts±0.5V, according to the conventional structure of 2T1C, the maximum current drift is 81%; while according to the structure of 5T2C of the present embodiment, the fluctuate of the current is less than 3.5%.

Meanwhile, the current $I_{OLED}$ correlates to the threshold voltage $V_{OLED_0}$ of the OLED, which can compensate the luminance loss due to the aging of OLED. When an OLED device ages, $V_{OLED_0}$ would increase gradually, and the luminous efficiency would lower, and thus it requires more current supplied from the driving transistor 21 to maintain the same luminance. However, in practice, if $V_{Data}<0$ and $V_{Data}<V_{OLED_0}$, then $|V_{Data}-V_{OLED_0}|$ would increase as the $V_{OLED_0}$ increases, which allows $I_{OLED}$ to increase so as to compensate the luminance loss of the OLED.

If the threshold voltage of the OLED drifts, then the drifted threshold voltage can be expressed as $V'_{OLED_0}=V_{OLED_0}+\Delta_{VOLED_0}$. From the Taylor series, it can be known that the first order approximate expansion of $I_{OLED}$ relative to $\Delta V_{OLED_0}$ is as below:

$$I_{OLED} = \frac{1}{2}\cdot\mu_p\cdot C_{ox}\cdot\frac{W}{L}\cdot\left[\frac{C_3}{C_{24}+C_3}\cdot(V_{Data}-V_{OLED_0})\right]^2 + \mu_p\cdot C_{ox}\cdot\frac{W}{L}\cdot\left[\frac{C_3}{C_{24}+C_3}\cdot(V_{Data}-V_{OLED_0})\right]\cdot\Delta V_{OLED_0}$$

As there is a linear relation presented between $I_{OLED}$ and $\Delta V_{OLED_0}$, in a specific implementation, based on the measuring result of the aging of OLED, the luminance loss due to the aging of OLED can be appropriately compensated by adjusting the coefficient of $\Delta V_{OLED_0}$ via adjustment of the ratio of capacitance of the capacitor 24 to that of capacitor 3 to complement the curve of luminance $-\Delta V_{OLED_0}$.

Figure 14:
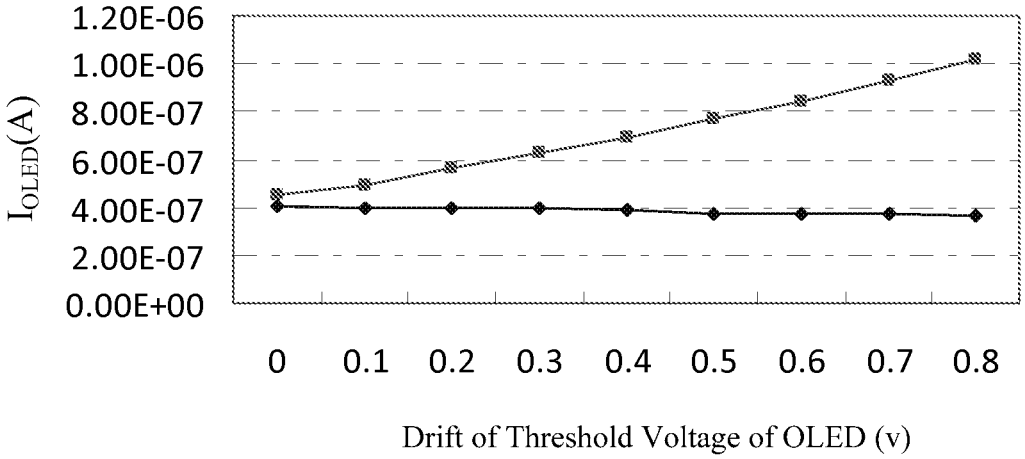
FIG. 14 is a schematic diagram of simulation result of a pixel unit circuit of an embodiment of the present disclosure for compensating the aging of OLED.

FIG. 14 is a schematic diagram of simulation result of a pixel unit circuit of an embodiment of the present disclosure for compensating the aging of OLED, wherein —◆— represents the relation between the threshold voltage of OLED and $I_{OLED}$ of the conventional structure of 2T1C, and —■— represents the relation between the threshold voltage of OLED and $I_{OLED}$ of structure of 5T2C of the present embodiment. As shown in FIG. 14, when the threshold voltage of OLED drifts 0~0.8V, according to the conventional structure of 2T1C, the current has a tendency of decreasing slowly which would aggravate the luminance loss of display; while according to the structure of 5T2C of the present embodiment, the current increases linearly in synchronization with the increase of the threshold voltage of OLED, which can effectively compensate the luminance loss of OLED. The speed and range at which the current increases can be controlled by adjusting the ratio of the capacitance of capacitor 24 to that of capacitor 3.

By comparing simulation result, the pixel unit circuit of the present embodiment can effectively compensate the non-uniformity of the threshold voltage of the transistor and IR Drop, control the current drift to about 2.5% and 3.5% respectively, and is applicable to a large size panel display. In particular, the present embodiment can compensate the luminance loss due to the aging of OLED, and thus significantly improves the life span of the product.

Figure 15:
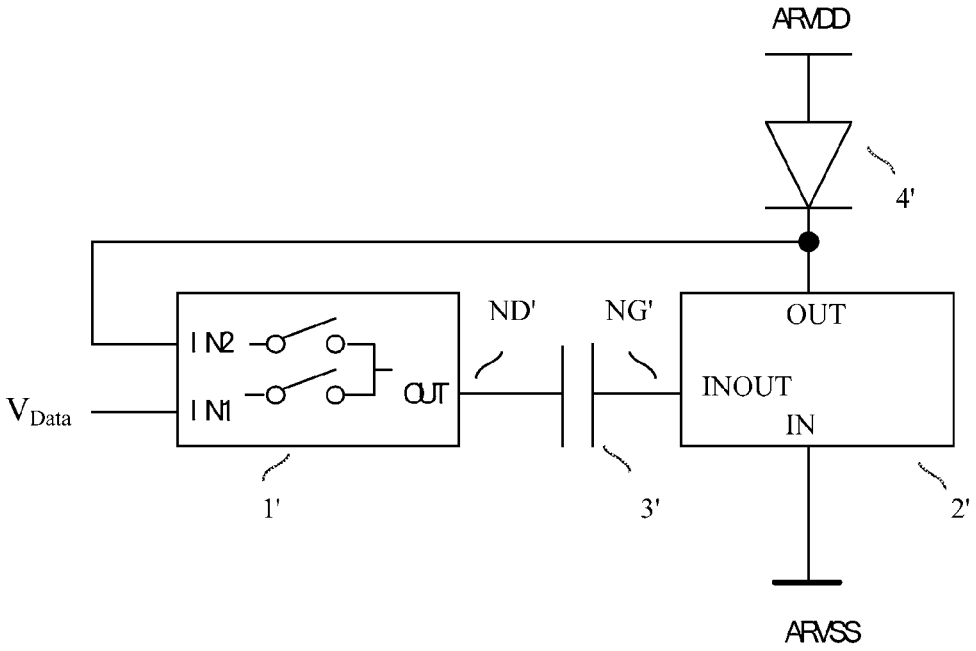
FIG. 15 is a schematic diagram of overall structure of a pixel unit circuit implemented by N type transistors which are switched-on by high level.

Note that not only P type transistors switched-on by low level (as shown in FIG. 6) but also N type transistor switched-on by high level can be employed in the pixel unit circuit of the embodiment of the disclosure. FIG. 15 illustrates an overall structure of a pixel unit circuit implemented by N type transistors switched-on on by high level, FIG. 16 illustrates the detailed structure thereof, and FIG. 17 shows the waveforms of the corresponding control signals SCAN', EM' and EMB'.

As illustrated in FIG. 15, the pixel unit circuit of the embodiment comprises a sub-circuit module 1', a sub-circuit module 2', a capacitor 3' and an OLED 4'. The sub-circuit module 1' has two inputs and one output, and the two inputs of the sub-circuit module 1' are connected to a data line and a cathode of the OLED respectively, the output of the sub-circuit module 1' is connected to one terminal of the capacitor 3' and corresponds to ND' node. The sub-circuit module 2' has one input, one input/output and one output, the input of the sub-circuit module 2' is connected to ARVSS, the input/output of the sub-circuit module 2' is connected to the other terminal of the capacitor 3' and corresponds to NG' node, and the output of the sub-circuit module 2' is connected to the cathode of the OLED 4'. The anode of the OLED 4' is connected to ARVDD.

Figure 16:
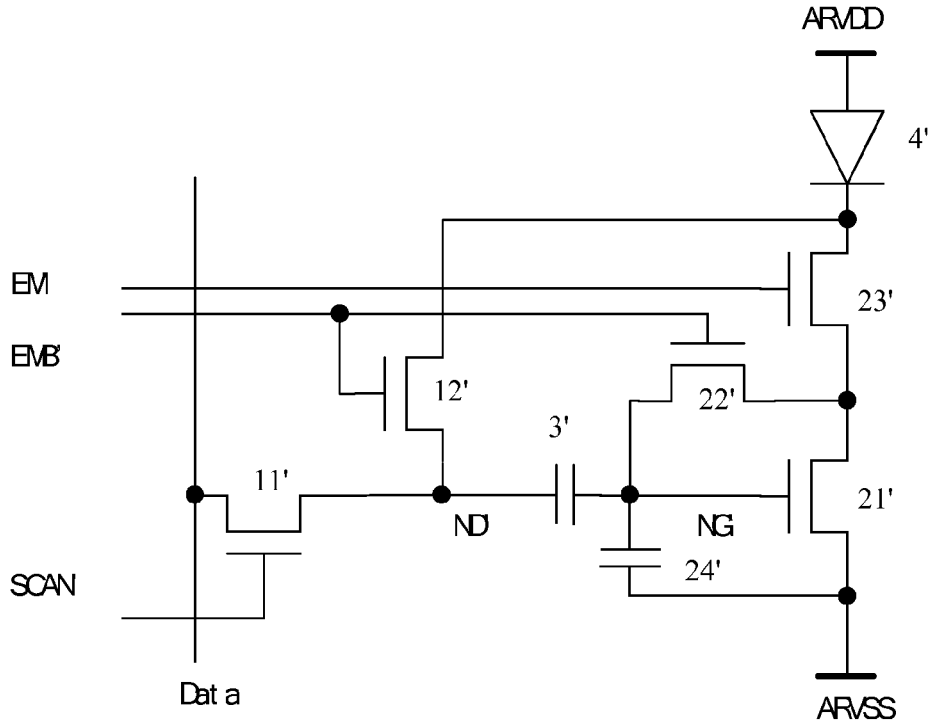
FIG. 16 is a schematic diagram of detailed structure of a pixel unit circuit implemented by N type transistors which are switched-on by high level.
Figure 17:
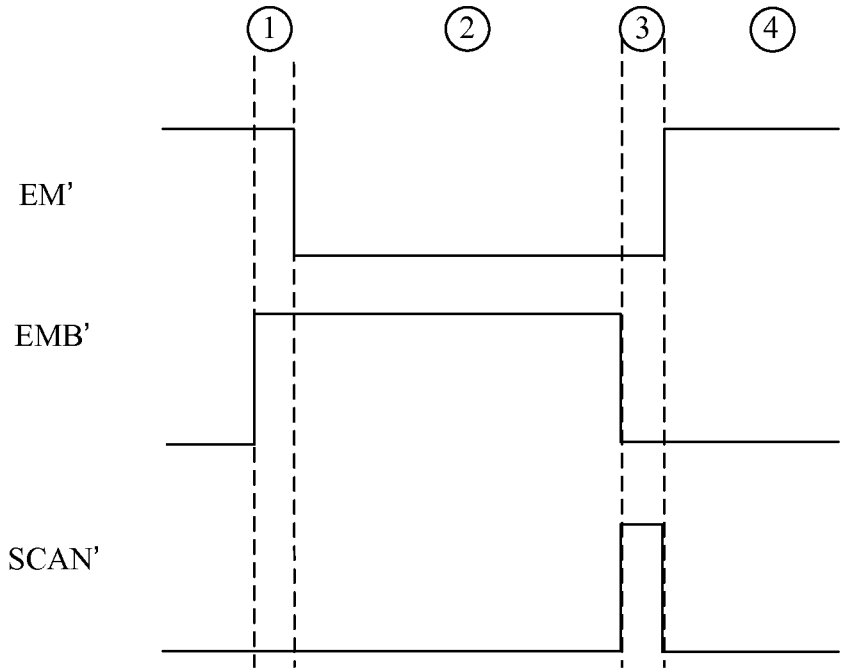
FIG. 17 is a schematic diagram of waveforms of control signals SCAN', EM' and EMB' in an embodiment of the present disclosure.

As illustrated in FIG. 16, the sub-circuit module 1' may include transistors 11' and 12' which are N type TFT transistors. A gate of transistor 11' receives the control signal SCAN', a source thereof is connected to a data line, and a drain thereof is connected to the ND' node. A gate of transistor 12' receives the control signal EMB', a drain thereof is connected to the ND' node, and a source thereof is connected to the cathode of the OLED 4'.

The sub-circuit module 2' may include transistors 21', 22', and 23', which are N type TFT transistors, and a capacitor 24'. A gate of transistor 21' is connected to the NG' node, a drain thereof is connected to ARVSS. A gate of transistor 22' receives the control signal EMB', a drain thereof is connected to the NG' node, and a source thereof is connected to the source of transistor 21'. A gate of transistor 23' receives the control signal EM', a drain thereof is connected to the source of transistor 21', and a source thereof is connected to the cathode of the OLED 4'. One terminal of the capacitor 24' is connected to the NG' node, and the other terminal thereof is connected to ARVSS.

The operation of the pixel unit circuit shown in FIG. 15 can be divided into two phases, wherein a first phase is a compensation period, and during the period, the voltage at the ND' node is controlled to ARVDD$-V_{OLED_0}$; at this time, the NG' node of the sub-circuit module 2' functions as an output port, and the voltage at the NG' node is controlled to $V_{th}$, $V_{th}$ representing the threshold voltage of the transistors used in the pixel unit circuit; a second phase is an evaluation period, and during the period, the voltage at the ND' node output from the sub-circuit module 1' is controlled to $V_{Data}$; at this time, the NG' node of the sub-circuit module 2' functions as an input port, and the voltage at the NG' node changes to $k\cdot(V_{Data}-\text{ARVDD}-V_{OLED_0})+V_{th}$ due to the bootstrap effect of the capacitor.

The operation of the pixel unit circuit as shown in FIG. 16, which is based on the waveforms of the control signals illustrated in FIG. 17, can be divided into four phases as below.

A first phase: wherein SCAN' is at low level, EM' and EMB' are at high level, and thus the transistors 21', 22',12' and 23' switch on, the transistor 11' switches off, and capacitor 3' is discharged.

A second phase, wherein SCAN' is at low level, EMB' is at high level, and EM' is at low level, and thus the transistors 21', 22' and 12' switch on, the transistors 11' and 23' switch off, the transistor 21' functions as a diode, and the voltage at the NG' node is discharged to ARVSS via the transistor 21' and gradually decreases to switch off the transistor 21'; at the same time, the ND' node is charged by ARVDD.

A third phase, wherein SCAN' is at high level, EM' and EMB' are low level, and thus the transistors 21' and 11' switch on, and the transistors 22', 12' and 23' switch off.

A fourth phase, wherein SCAN' is at low level, EM' is at high level, and EMB' is at low level, and thus the transistor 21', 23' switch on, and the transistors 22', 11' and 12' switch off, and OLED 4' emits light.

The above transistors 11', 12', 21', 22' and 23' are N type TFT transistor.

It is proposed in the present disclosure an OLED display apparatus, wherein the OLED display apparatus may include a plurality of the pixel unit circuits shown in FIG. 5, 6, 15 or 16 connected in series.

It can be seen that the present disclosure can effectively compensate the aging of OLED devices, the non-uniformity of threshold voltage of TFT driving transistor, and IR Drop of the power supply of backboard by utilizing a pixel unit circuit structure of AMOLED based on a voltage feedback technique, and thus enhances the display effect.

The above descriptions are only for illustrating the preferred embodiments of the present disclosure, and in no way limit the scope of the present disclosure. The embodiment of the disclosure being thus described, it will be obvious that the same may be varied in many ways. Such variations are not to be regarded as a departure from the spirit and scope of the disclosure, and all such modifications as would be obvious to those skilled in the art are intended to be included within the scope of the following claims.

What is claimed is:

1. A pixel unit circuit comprising a first sub-circuit module, a second sub-circuit module, a first capacitor and an Organic Light-Emitting Diode (OLED) wherein an input of the first sub-circuit module is connected to a data line;

another input of the first sub-circuit module is connected to an output of the second sub-circuit module and a first terminal of the OLED;

an output of the first sub-circuit module is connected to an input/output of the second sub-circuit module via the first capacitor; and a voltage difference between positive power supply and negative power supply of a backboard is applied between an input of the second sub-circuit module and a second terminal of the OLED, wherein the first terminal of the OLED is an cathode of the OLED, and the second terminal of the OLED is an anode of the OLED the another input of the first sub-circuit module is connected to the cathode of the OLED, and the output of the first sub-circuit module (1') is ND' node and is connected to one terminal of the first capacitor;

the input of the second sub-circuit module is connected to ARVSS, the input/output of the second sub-circuit module is NG' node and is connected to the other terminal of the first capacitor, the output of the second sub-circuit module (2') is connected to the cathode of the OLED; and the anode of the OLED is connected to ARVDD.

2. The pixel unit circuit of claim 1, wherein the first sub-circuit module includes a first transistor and a second transistor, wherein the first and second transistors are N type TFT transistors; wherein, a gate of the first transistor receives a control signal SCAN', a source thereof is connected to the data line, and a drain thereof is connected to the ND' node;

a gate of the second transistor receives a control signal EMB', a drain thereof is connected to the ND' node, and a source thereof is connected to the cathode of the OLED.

3. The pixel unit circuit of claim 2, wherein the second sub-circuit module includes a third transistor, a fourth transistor, a fifth transistor and a second capacitor, wherein the third, fourth and fifth transistors are N type transistors; wherein a gate of the third transistor is connected to the NG' node, and a drain thereof receives ARVSS;

a gate of the fourth transistor receives a control signal EMB', a drain thereof is connected to the NG' node, and a source thereof is connected to the source of the third transistor;

a gate of the fifth transistor receives a control signal EM', a drain thereof is connected to the source of the third transistor, and the source thereof is connected to the cathode of the OLED; and one terminal of the second capacitor is connected to the NG' node, and the other terminal is connected to ARVSS.

4. The pixel unit circuit of claim 3, wherein the pixel unit circuit operates in the following sequence:

a first phase, wherein SCAN' is at low level, EM' and EMB' are at high level, and thus the second transistor, the third transistor, the fourth transistor and the fifth transistor switch on, the first transistor switches off, and the first capacitor is discharged;

a second phase, wherein SCAN' is at low level, EMB' is at high level, and EM' is at low level, and thus the second transistor, the third transistor and the fourth transistor switch on, the first transistor and the fifth transistor switch off, and the third transistor functions as a diode, then the voltage at the NG' node is discharged to ARVSS by the third transistor and decreases gradually to switch the third transistor off; at the same time, the ND' node is charged by ARVDD;

a third phase, wherein SCAN' is at high level, and EM' and EMB' are at low level, and thus the first transistor and the third transistor switch on, the second transistor, the fourth transistor and the fifth transistor switch off; and a fourth phase, wherein SCAN' is at low level, EM' is at high level, and EMB is at low level, and thus the third transistor and the fifth transistor switch on, the first transistor, the second transistor and the fourth transistor switch off, and the OLED emits light.

5. A pixel unit circuit comprising a first sub-circuit module, a second sub-circuit module, a first capacitor and an Organic Light-Emitting Diode (OLED), wherein an input of the first sub-circuit module is connected to a data line;

another input of the first sub-circuit module is connected to an output of the second sub-circuit module and a first terminal of the OLED;

an output of the first sub-circuit module is connected to an input/output of the second sub-circuit module via the first capacitor; and a voltage difference between positive power supply and negative power supply of a backboard is applied between an input of the second sub-circuit module and a second terminal of the OLED, wherein the first sub-circuit module is used for selecting an input voltage to be output to the first capacitor; and the second sub-circuit module is used for converting the input voltage into a current to be provided to the OLED;

wherein the first terminal of the OLED is an anode of the OLED, and the second terminal of the OLED is a cathode of the OLED (4); the another input of the first sub-circuit module is connected to the anode of the OLED, and the output of the first sub-circuit module (1) is ND node and is connected to one terminal of the first capacitor (3); the input of the second sub-circuit module (2) is connected to the positive power supply of the backboard ARVDD, the input/output of the second sub-circuit module (2) is NG node and is connected to the other terminal of the first capacitor (3), the output of the second sub-circuit module (2) is connected to the anode of the OLED (4); and the cathode of the OLED (4) is connected to the negative power supply of the backboard ARVSS;

wherein the first sub-circuit module includes a first transistor and a second transistor, wherein the first and second transistors are P type TFT transistors; wherein a gate of the first transistor receives a control signal SCAN, a source of the first transistor is connected to the data line, and a drain thereof is connected to the ND node; and a gate of the second transistor receives a control signal EMB, a drain thereof is connected to the ND node, and a source thereof is connected to the anode of the OLED;

wherein the second sub-circuit module includes a third transistor, a fourth transistor, a fifth transistor and a second capacitor, wherein the third, fourth and fifth transistors are P type transistors; wherein a gate of the third transistor is connected to the NG node, and a drain thereof receives ARVDD; a gate of the fourth transistor receives a control signal EMB, a drain thereof is connected to the NG node, and a source thereof is connected to the source of the third transistor; a gate of the fifth transistor receives a control signal EM, a drain thereof is connected to the source of the third transistor, and the source thereof is connected to the anode of the OLED; and one terminal of the second capacitor is connected to the NG node, and the other terminal is connected to ARVDD;

the pixel unit circuit operates in the following sequence:

a first phase, wherein SCAN is at high level, EM and EMB are at low level, and thus the second transistor, the third transistor, the fourth transistor and the fifth transistor switch on, the first transistor switches off, and the first capacitor is discharged;

a second phase, wherein SCAN is at high level, EMB is at low level, and EM is at high level, and thus at the moment that the EM toggles high, the second transistor, the third transistor and the fourth transistor switch on, the first transistor and fifth transistor switch off, and the third transistor functions as a diode, then the voltage at the NG node is charged by ARVDD and rises gradually to switch the third transistor off; at the same time, the ND node is discharged by the OLED;

a third phase, wherein SCAN is at low level, and EM and EMB are at high level, and thus the first transistor and the third transistor switch on, the second transistor, the fourth transistor and the fifth transistor switch off; and a fourth phase, wherein SCAN is at high level, EM is at low level, and EMB is at high level, and thus the third transistor and the fifth transistor switch on, the first transistor, the second transistor and the fourth transistor switch off, and the OLED emits light.

6. An OLED display apparatus including a plurality of the pixel unit circuits connected in series, each of the pixel unit circuits includes: a first sub-circuit module, a second sub-circuit module, a first capacitor and an Organic Light-Emitting Diode(OLED), wherein an input of the first sub-circuit module is connected to a data line;

another input of the first sub-circuit module is connected to an output of the second sub-circuit module and a first terminal of the OLED;

an output of the first sub-circuit module is connected to an input/output of the second sub-circuit module via the first capacitor; and a voltage difference between positive power supply and negative power Supply of a backboard is applied between an input of the second sub-circuit module and a second terminal of the OLED, wherein the first terminal of the OLED is a cathode of the OLED, and the second terminal of the OLED is an anode of the OLED;

the another input of the first sub-circuit module is connected to the cathode of the OLED, and the output of the first sub-circuit module is ND' node and is connected to one terminal of the first capacitor;

the input of the second sub-circuit module is connected to ARVSS, the input/output of the second sub-circuit module is NG' node and is connected to the other terminal of the first capacitor, the output of the second sub-circuit module is connected to the cathode of the OLED; and the anode of the OLED is connected to ARVDD.

7. The OLED display apparatus of claim 6, wherein the first sub-circuit module includes a first transistor and a second transistor, wherein the first and second transistors are N type TFT transistors; wherein, a gate of the first transistor receives a control signal SCAN', a source thereof is connected to the data line, and a drain thereof is connected to the ND' node; and a gate of the second transistor receives a control signal EMB', a drain thereof is connected to the ND' node, and a source thereof is connected to the cathode of the OLED.

8. The OLED display apparatus of claim 7, wherein the second sub-circuit module includes a third transistor, a fourth transistor, a fifth transistor and a second capacitor, wherein the third, fourth and fifth transistors are N type transistors; wherein a gate of the third transistor is connected to the NG' node, and a drain thereof receives ARVSS;

a gate of the fourth transistor receives a control signal EMB', a drain thereof is connected to the NG' node, and a source thereof is connected to the source of the third transistor;

a gate of the fifth transistor receives a control signal EM', a drain thereof is connected to the source of the third transistor, and the source thereof is connected to the cathode of the OLED; and one terminal of the second capacitor is connected to the NG' node, and the other terminal is connected to ARVSS.

* * * * *